US006733551B2

(12) United States Patent
Carabell et al.

(10) Patent No.: US 6,733,551 B2
(45) Date of Patent: May 11, 2004

(54) METHOD OF IMPROVING THE COMPATIBILITY OF A FUEL ADDITIVE COMPOSITION CONTAINING A MANNICH CONDENSATION PRODUCT

(75) Inventors: Kevin D. Carabell, Fairfax, CA (US); James A. Gray, Novato, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 1 day.

(21) Appl. No.: 10/175,143

(22) Filed: Jun. 18, 2002

(65) Prior Publication Data

US 2004/0000089 A1 Jan. 1, 2004

(51) Int. Cl.[7] ..... C10L 1/18; C10L 1/22

(52) U.S. Cl. ..... 44/385; 44/415; 44/443; 44/459; 44/333; 44/339

(58) Field of Search ..... 44/385, 415, 443, 44/459, 333, 339

(56) References Cited

U.S. PATENT DOCUMENTS

| | | | | | |
|---|---|---|---|---|---|
| 3,798,247 | A | | 3/1974 | Piasek et al. | 260/404.5 |
| 4,231,759 | A | | 11/1980 | Udelhofen et al. | 44/75 |
| 4,334,085 | A | | 6/1982 | Basalay et al. | 564/367 |
| 4,357,148 | A | * | 11/1982 | Graiff | 44/432 |
| 4,877,416 | A | * | 10/1989 | Campbell | 44/432 |
| 5,006,130 | A | * | 4/1991 | Aiello et al. | 44/432 |
| 5,089,028 | A | * | 2/1992 | Abramo et al. | 44/347 |
| 5,360,460 | A | * | 11/1994 | Mozdzen et al. | 44/386 |
| 5,405,419 | A | | 4/1995 | Ansari et al. | 44/412 |
| 5,514,190 | A | * | 5/1996 | Cunningham et al. | 44/415 |
| 5,634,951 | A | * | 6/1997 | Colucci et al. | 44/415 |
| 5,679,116 | A | * | 10/1997 | Cunningham et al. | 44/359 |
| 5,697,988 | A | * | 12/1997 | Malfer et al. | 44/415 |
| 5,876,468 | A | * | 3/1999 | Moreton | 44/415 |
| 6,048,373 | A | * | 4/2000 | Malfer et al. | 44/415 |

* cited by examiner

*Primary Examiner*—Margaret B. Medley
(74) *Attorney, Agent, or Firm*—Steven G. K. Lee

(57) ABSTRACT

A method of improving the compatibility of a fuel additive composition comprising blending together the following components:

a) a Mannich condensation product of (1) a high molecular weight alkyl-substituted hydroxyaromatic compound, (2) an amine having the formula:

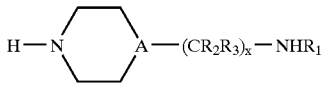

wherein A is CH or nitrogen, $R_1$, $R_2$, $R_3$ are independently hydrogen or lower alkyl of 1 to about 6 carbon atoms and each $R_2$ and $R_3$ is independently selected in each —$CR_2R_3$— unit, and x is an integer from 1 to about 6;

and (3) an aldehyde, wherein the respective molar ratio of reactants (1), (2), and (3) is 1:0.1–2:0.1–2;

b) a hydrocarbyl-terminated poly(oxyalkylene) monool;

c) a carboxylic acid as represented by the formula:

$R_4(COOH)_y$ wherein $R_4$ represents a hydrocarbyl group having about 2 to about 50 carbon atoms, and y represents an integer of 1 to about 4; and d) an anhydride selected from the group consisting of succinic, glutaric, phthalic, and alkyl anhydrides.

31 Claims, No Drawings

METHOD OF IMPROVING THE COMPATIBILITY OF A FUEL ADDITIVE COMPOSITION CONTAINING A MANNICH CONDENSATION PRODUCT

BACKGROUND OF THE INVENTION

1. Field of the Invention

The present invention relates to a method of improving the compatibility of a fuel additive composition. In particular, the present invention improves the compatibility of the fuel additive composition by blending together a fuel additive composition containing a Mannich condensation product, a hydrocarbyl-terminated poly(oxyalkylene) monool and a certain combination of a carboxylic acid and an anhydride.

2. Description of the Related Art

Mannich condensation products are known in the art as fuel additives for the prevention and control of engine deposits. For example, U.S. Pat. No. 4,231,759, issued Nov. 4, 1980 to Udelhofen et al., discloses reaction products obtained by the Mannich condensation of a high molecular weight alkyl-substituted hydroxyaromatic compound, an amine containing an amino group having at least one active hydrogen atom, and an aldehyde, such as formaldehyde. This patent further teaches that such Mannich condensation products are useful detergent additives in fuels for the control of deposits on carburetor surfaces and intake valves.

Generally, Mannich condensation products are utilized in combination with other fuel additive components. For example, polyolefins and polyether compounds are also well known in the art as fuel additives. It is not uncommon for the literature to refer to the enhanced benefits of the combination of two or more such fuel additives for the prevention and control of engine deposits.

U.S. Pat. No. 5,405,419, issued Apr. 11, 1995 to Ansari et al., discloses a fuel additive composition comprising (a) a fuel-soluble aliphatic hydrocarbyl-substituted amine having at least one basic nitrogen atom wherein the hydrocarbyl group has a number average molecular weight of about 700 to 3,000; (b) a polyolefin polymer of a $C_2$ to $C_6$ monolefin, wherein the polymer has a number average molecular weight of about 350 to 3,000; and (c) a hydrocarbyl-terminated poly(oxyalkylene) monool having an average molecular weight of about 500 to 5,000. This patent further teaches that fuel compositions containing these additives will generally contain about 50 to 500 ppm by weight of the aliphatic amine, about 50 to 1,000 ppm by weight of the polyolefin and about 50 to 1,000 ppm by weight of the poly(oxyalkylene) monool. This patent also discloses that fuel compositions containing 125 ppm each of aliphatic amine, polyolefin and poly(oxyalkylene) monool provide better deposit control performance than compositions containing 125 ppm of aliphatic amine plus 125 ppm of poly (oxyalkylene) monool.

In fuel additive applications, the presence of small amounts of low molecular weight amine in dispersant components such as the Mannich condensation product can lead to formulation incompatibilities (for example, with certain corrosion inhibitors or demulsifiers) and air sensitivity (for example, reaction with carbon dioxide in the air). For example, corrosion inhibitors are typically complex mixtures of organic acids of wide molecular weight range. These can react with trace amounts of low molecular weight amines in the Mannich component at room temperature to form insoluble salts and at higher temperatures to form insoluble amides. Formulation incompatibility and air sensitivity are manifested by formation of haze, floc, solids, and/or gelatinous material in the formulation over time. The incompatibility may occur in the absence of air. Consequently, the manufacturing process for amine dispersant type fuel additives may include a step to remove low molecular weight amines to low levels, or the compatibility issue may be addressed during formulation. However, the unique chemistry of Mannich condensation products must be considered with either approach. In particular, the chemical equilibrium can generate additional low molecular weight amines if the product is heated too much during the purification step or after a formulation has been prepared. Therefore, there is a need for either an economical process to reduce the unconsumed amine and the amine-formaldehyde intermediate to a low level after the Mannich reaction or a chemical scavenger that renders the water-soluble amine harmless to formulation compatibility and that reduces formulation air sensitivity.

U.S. Pat. No. 3,798,247 issued Mar. 19, 1974 to Piasek and Karil, discloses that the reaction under Mannich condensation conditions, like other chemical reactions, does not go to theoretical completion and some portion of the reactants, generally the amine, remains unreacted or only partially reacted as a coproduct. Unpurified products of Mannich processes also commonly contain small amounts of insoluble particle byproducts of the Mannich condensation reaction that appear to be the high molecular weight condensation product of formaldehyde and polyamines. The amine and amine byproducts lead to haze formation during storage and, in diesel oil formulations, to rapid buildup of diesel engine piston ring groove carbonaceous deposits and skirt varnish. The insoluble or borderline soluble byproducts are substantially incapable of removal by filtration and severely restrict product filtration rate. These drawbacks were overcome by adding long-chain carboxylic acids during the reaction to reduce the amount of solids formation from the Mannich reaction. This was thought to render the particulate polyamine-formaldehyde condensation product soluble through formation of amide-type links. In particular, oleic acid worked well at 0.1 to 0.3 mole/mole of alkylphenol. The quantity of unconsumed or partially reacted amine was not mentioned in the patent.

U.S. Pat. No. 4,334,085, issued Jun. 6, 1982 to Basalay and Udelhofen, discloses that Mannich condensation products can undergo transamination, and use this to solve the problem of byproduct amine-formaldehyde resin formation encountered in U.S. Pat. No. 3,798,247 eliminating the need for using a fatty acid. U.S. Pat. No. 4,334,085 defined transamination as the reaction of a Mannich adduct based on a single-nitrogen amine with a polyamine to exchange the polyamine for the single-nitrogen amine. The examples in this patent infer that the unconsumed amine and partially reacted amine discussed in U.S. Pat. No. 3,798,247 are not merely unconsumed, but must be in chemical equilibrium with the product of the Mannich condensation reaction. In Example 1 of U.S. Pat. No. 4,334,085, a Mannich condensation product is made from 0.5 moles of polyisobutylphenol, 1.0 mole of diethylamine and 1.1 moles of formaldehyde. To 0.05 moles of this product was added 0.05 moles of tetraethylenepentamine (TEPA) and then the mixture was heated to 155° C. while blowing with nitrogen. The TEPA replaced 80 to 95% of the diethylamine in the Mannich as the nitrogen stripped off the diethylamine made available by the equilibrium with the Mannich.

U.S. Pat. No. 5,360,460, issued Nov. 1, 1994 to Mozdzen et al., discloses a fuel additive composition comprising (A)

an alkylene oxide condensate or the reaction product thereof and an alcohol, (B) a monocarboxylic fatty acid, and (C) a hydrocarbyl amine, or the reaction product thereof and an alkylene oxide. The fuel additive composition deals with cleaning of injection ports, lubricating a fuel line system in a diesel vehicle, and with minimizing corrosion in the fuel line system. However, the use of a Mannich condensation product is neither disclosed nor suggested.

SUMMARY OF THE INVENTION

We have discovered a novel method of improving the compatibility of a fuel additive composition by blending together a fuel additive composition containing a Mannich condensation product, a hydrocarbyl-terminated poly (oxyalkylene) monool, and a certain combination of a carboxylic acid and an anhydride.

Accordingly, the present invention provides a novel method of improving the compatibility of a fuel additive composition comprising blending together the following components:

a) a Mannich condensation product of (1) a high molecular weight alkyl-substituted hydroxyaromatic compound wherein the alkyl group has a number average molecular weight of from about 300 to about 5,000 (2) an amine having the formula:

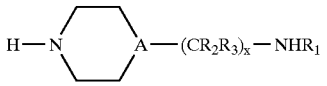

wherein A is CH or nitrogen, $R_1$, $R_2$, $R_3$ are independently hydrogen or lower alkyl of 1 to about 6 carbon atoms and each $R_2$ and $R_3$ is independently selected in each $—CR_2R_3—$ unit, and x is an integer from 1 to about 6;

and (3) an aldehyde, wherein the respective molar ratio of reactants (1), (2), and (3) is 1:0.1–2.0:0.1–2.0;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group;

c) a carboxylic acid as represented by the formula:

$$R_4(COOH)_y$$

wherein $R_4$ represents a hydrocarbyl group having about 2 to about 50 carbon atoms, and y represents an integer of 1 to about 4; and d) an anhydride selected from the group consisting of succinic, glutaric, phthalic, and alkyl anhydrides.

Among other factors, the present invention is based on the surprising discovery that the formulation compatibility is greatly improved by the combination of a selected carboxylic acid and anhydride that interacts with the residual amine. Typically, the residual amines are small quantities of low molecular weight amine and amine-formaldehyde intermediates in the Mannich which interact with organic acid mixtures that are typically used in fuel additive formulations to provide anti-corrosion properties. The low molecular weight amines can also interact with carbon dioxide from exposure of the formulation to air. The interaction can lead to formation of insoluble material, haze, and flocs. In addition, the selected carboxylic acid and anhydride provides anti-corrosion properties. Thus, the improved compatibility and air sensitivity manifests itself in less insoluble material, haze, and flocs.

DETAILED DESCRIPTION OF THE INVENTION

The novel method of the present invention improves the compatibility of a fuel additive composition by blending together a fuel additive composition containing a Mannich condensation product, a hydrocarbyl-terminated poly (oxyalkylene) monool, and a certain combination of a carboxylic acid and an anhydride.

Definitions

Prior to discussing the present invention in detail, the following terms will have the following meanings unless expressly stated to the contrary.

The term "hydrocarbyl" refers to an organic radical primarily composed of carbon and hydrogen which may be aliphatic, alicyclic, aromatic or combinations thereof, e.g., aralkyl or alkaryl. Such hydrocarbyl groups may also contain aliphatic unsaturation, i.e., olefinic or acetylenic unsaturation, and may contain minor amounts of heteroatoms, such as oxygen or nitrogen, or halogens, such as chlorine. When used in conjunction with carboxylic fatty acids, hydrocarbyl will also include olefinic unsaturation.

The term "alkyl" refers to both straight- and branched-chain alkyl groups.

The term "alkylene" refers to straight- and branched-chain alkylene groups having at least 1 carbon atom. Typical alkylene groups include, for example, methylene ($—CH_2—$), ethylene ($—CH_2CH_2—$), propylene ($—CH_2CH_2CH_2—$), isopropylene ($—CH(CH_3)CH_2—$), n-butylene ($—CH_2CH_2CH_2CH_2—$), sec-butylene ($—CH(CH_2CH_3)CH_2—$), n-pentylene ($—CH_2CH_2CH_2CH_2CH_2—$), and the like.

The term "polyoxyalkylene" refers to a polymer or oligomer having the general formula:

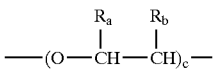

wherein $R_a$ and $R_b$ are each independently hydrogen or lower alkyl groups, and c is an integer from about 5 to about 100. When referring herein to the number of oxyalkylene units in a particular polyoxyalkylene compound, it is to be understood that this number refers to the average number of oxyalkylene units in such compounds unless expressly stated to the contrary.

The term "fuel" or "hydrocarbon fuel" refers to normally liquid hydrocarbons having boiling points in the range of gasoline and diesel fuels.

The Mannich Condensation Product

Mannich reaction products employed in this invention are obtained by condensing an alkyl-substituted hydroxyaromatic compound whose alkyl-substituent has a number average molecular weight of from about 300 to about 5,000, preferably polyalkylphenol whose polyalkyl substituent is derived from 1-mono-olefin polymers having a number average molecular weight of from about 300 to about 5,000, more preferably from about 400 to about 3,000; a cyclic amine containing a primary and secondary amino group or two secondary amino groups; and an aldehyde, preferably formaldehyde, in the presence of a solvent.

The overall reaction may be illustrated by the following:

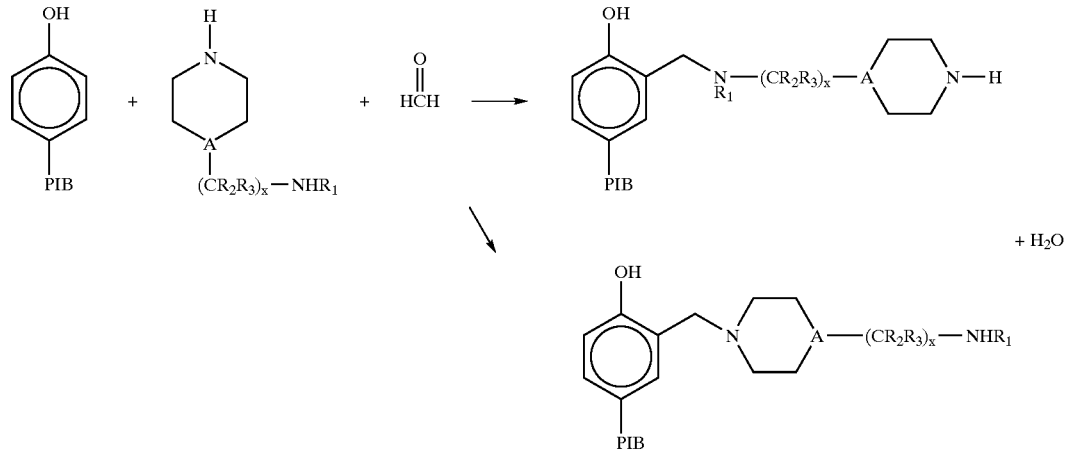

wherein A, $R_1$, $R_2$, $R_3$ and x are as defined herein.

High molecular weight Mannich reaction products useful as additives in the fuel additive compositions of this invention are preferably prepared according to conventional methods employed for the preparation of Mannich condensation products, using the above-named reactants in the respective molar ratios of high molecular weight alkyl-substituted hydroxyaromatic compound, amine, and aldehyde of approximately 1:0.1–2.0:0.1–2.0. Preferably, the respective molar ratios will be 1:0.5–1.5:0.5–1.5. More preferably, the respective molar ratios will be 1:0.8–1.3:0.8–1.3. A suitable condensation procedure involves adding at a temperature of from room temperature to about 95° C., the formaldehyde reagent (e.g., formalin) to a mixture of amine and alkyl-substituted hydroxyaromatic compounds alone or in an easily removed organic solvent, such as benzene, xylene, or toluene or in solvent-refined neutral oil, and then heating the reaction mixture at an elevated temperature (about 120° C. to about 175° C.) while the water of reaction is distilled overhead and separated. The reaction product so obtained is finished by filtration and dilution with solvent as desired.

The most preferred Mannich reaction product additives employed in this invention are derived from high molecular weight Mannich condensation products, formed by reacting an alkylphenol, an amine of the present invention, and a formaldehyde affording reactants in the respective molar ratio of 1:1:1.05, wherein the alkyl group of the alkylphenol has a number average weight of from about 300 to about 5,000.

Representative of the high molecular weight alkyl-substituted hydroxyaromatic compounds are polypropylphenol, polybutylphenol, and other polyalkylphenols, with polyisobutylphenol being the most preferred. Polyalkylphenols may be obtained by the alkylation, in the presence of an alkylating catalyst such as $BF_3$, of phenol with high molecular weight polypropylene, polybutylene, and other polyalkylene compounds to give alkyl substituents on the benzene ring of phenol having a number average molecular weight of from about 300 to about 5,000.

The alkyl substituents on the hydroxyaromatic compounds may be derived from high molecular weight polypropylenes, polybutenes, and other polymers of mono-olefins, principally 1-mono-olefins. Also useful are copolymers of mono-olefins with monomers copolymerizable therewith, wherein the copolymer molecule contains at least about 90% by weight of mono-olefin units. Specific examples are copolymers of butenes (1-butene, 2-butene, and isobutylene) with monomers copolymerizable therewith wherein the copolymer molecule contains at least about 90% by weight of propylene and butene units, respectively. Said monomers copolymerizable with propylene or said butenes include monomers containing a small proportion of unreactive polar groups, such as chloro, bromo, keto, ether, or aldehyde, which do not appreciably lower the oil-solubility of the polymer. The comonomers polymerized with propylene or said butenes may be aliphatic and can also contain non-aliphatic groups, e.g., styrene, methylstyrene, p-dimethylstyrene, divinyl benzene, and the like. From the foregoing limitation placed on the monomer copolymerized with propylene or said butenes, it is clear that said polymers and copolymers of propylene and said butenes are substantially aliphatic hydrocarbon polymers. Thus, the resulting alkylated phenols contain substantially alkyl hydrocarbon substitutents having a number average molecular weight of from about 300 to about 5,000.

In addition to the foregoing high molecular weight hydroxyaromatic compounds, other phenolic compounds which may be used include, high molecular weight alkyl-substituted derivatives of resorcinol, hydroquinone, cresol, cathechol, xylenol, hydroxy-di-phenyl, benzylphenol, phenethylphenol, naphthol, tolylnaphthol, among others. Preferred for the preparation of such preferred Mannich condensation products are the polyalkylphenol reactants, e.g., polypropylphenol and polybutylphenol, particularly polyisobutylphenol, whose alkyl group has a number average molecular weight of about 300 to about 5,000, preferably about 400 to about 3,000, more preferably about 500 to about 2,000, and most preferably about 700 to about 1,500.

As noted above, the polyalkyl substituent on the polyalkyl hydroxyaromatic compounds employed in the invention may be generally derived from polyolefins which are polymers or copolymers of mono-olefins, particularly 1-mono-olefins, such as ethylene, propylene, butylene, and the like. Preferably, the mono-olefin employed will have about 2 to about 24 carbon atoms, and more preferably, about 3 to about 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkyl hydroxyaromatic compounds are polyisobutenes which comprise at least about 20% of the more reactive methylvinylidene isomer, preferably at least about 50% and more preferably at least about 70% methylvinylidene isomer. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808.

Examples of suitable polyisobutenes having a high alkylvinylidene content include Ultravis 10, a polyisobutene having a molecular weight of about 950 and a methylvinylidene content of about 76%, and Ultravis 30, a polyisobutene having a molecular weight of about 1,300 and a methylvinylidene content of about 74%, both available from British Petroleum, and Glissopal 1000, 1300, and 2200, available from BASF.

The preferred configuration of the alkyl-substituted hydroxyaromatic compound is that of a para-substituted mono-alkylphenol. However, any alkylphenol readily reactive in the Mannich condensation reaction may be employed. Accordingly, ortho mono-alkylphenols and dialkylphenols are suitable for use in this invention.

The amine of the present invention contains both a primary and secondary amino group or two secondary amino groups. The general structure of the amine is illustrated by the following formula:

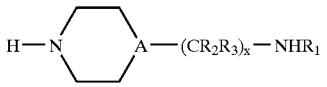

wherein A is CH or nitrogen, $R_1$, $R_2$, $R_3$ are independently hydrogen or lower alkyl having from 1 to about 6 carbon atoms, and x is an integer 1 to about 6. Preferably, A is CH or nitrogen, $R_1$ is hydrogen, $R_2$ and $R_3$ are independently hydrogen or lower alkyl having from 1 to about 4 carbon atoms, and x is an integer 1 to about 4. More preferably, A is CH or nitrogen, $R_1$, is hydrogen, $R_2$ and $R_3$ are independently hydrogen or lower alkyl having from 1 to about 2 carbon atoms, and x is an integer of about 2. Most preferably, A is nitrogen, $R_1$, $R_2$, $R_3$ are hydrogen, and x is an integer of about 2. In each of the preceding, each $R_2$ and $R_3$ is independently selected in each —$CR_2R_3$— unit.

Examples of amines are 1-piperazinemethanamine, 1-piperazineethanamine, 1-piperazinepropanamine, 1-piperazinebutanamine, α-methyl-1-piperazinepropanamine, N-ethyl-1-piperazineethanamine, N-(1,4-dimethylpentyl)-1-piperazineethanamine, 1-[2-(dodecylamino)ethyl]-piperazine, 1-[2-(tetradecylamino)ethyl]-piperazine, 4-piperidinemethanamine, 4-piperidineethanamine, 4-piperidinebutanamine, and N-phenyl-4-piperidinepropanamine. The most preferred amine of the Mannich condensation product of the present invention is 1-piperazineethanamine or 1-(2-aminoethyl) piperazine (AEP).

Representative aldehydes for use in the preparation of the high molecular weight Mannich reaction products employed in this invention include the aliphatic aldehydes such as formaldehyde, acetaldehyde, propionaldehyde, butyraldehyde, valeraldehyde, caproaldehyde, heptaldehyde, and stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

The Hydrocarbyl-Terminated Poly(oxyalkylene) Monool

The hydrocarbyl-terminated poly(oxyalkylene) polymers employed in the present invention are monohydroxy compounds, i.e., alcohols, often termed monohydroxy polyethers, or polyalkylene glycol monohydrocarbylethers, or "capped" poly(oxyalkylene) glycols and are to be distinguished from the poly(oxyalkylene) glycols (diols), or polyols, which are not hydrocarbyl-terminated, i.e., not capped. The hydrocarbyl-terminated poly(oxyalkylene) alcohols are produced by the addition of lower alkylene oxides, such as ethylene oxide, propylene oxide, the butylene oxides, or the pentylene oxides to the hydroxy compound $R_2OH$ under polymerization conditions, wherein $R_2$ is the hydrocarbyl group which caps the poly(oxyalkylene) chain. Methods of production and properties of these polymers are disclosed in U.S. Pat. Nos. 2,841,479 and 2,782,240 and Kirk-Othmer's "Encyclopedia of Chemical Technology", $2^{nd}$ Ed Volume 19, p. 507. In the polymerization reaction, a single type of alkylene oxide may be employed, e.g., propylene oxide, in which case the product is a homopolymer, e.g., a poly(oxyalkylene) propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of the present invention. Random polymers are more easily prepared when the reactivities of the oxides are relatively equal. In certain cases, when ethylene oxide is copolymerized with other oxides, the higher reaction rate of ethylene oxide makes the preparation of random copolymers difficult. In either case, block copolymers can be prepared. Block copolymers are prepared by contacting the hydroxyl-containing compound with first one alkylene oxide, then the others in any order, or repetitively, under polymerization conditions. A particular block copolymer is represented by a polymer prepared by polymerizing propylene oxide on a suitable monohydroxy compound to form a poly(oxypropylene) alcohol and then polymerizing butylene oxide on the poly(oxyalkylene) alcohol.

In general, the poly(oxyalkylene) polymers are mixtures of compounds that differ in polymer chain length. However, their properties closely approximate those of the polymer represented by the average composition and molecular weight.

The polyethers employed in this invention can be represented by the formula:

$$R_5O—(R_6O)_z—H$$

wherein $R_5$ is a hydrocarbyl group of from 1 to about 30 carbon atoms; $R_6$ is a $C_2$ to $C_5$ alkylene group; and z is an integer such that the molecular weight of the polyether is from about 500 to about 5,000.

Preferably, $R_5$ is a $C_7$ to $C_{30}$ alkylphenyl group. Most preferably, $R_5$ is dodecylphenyl.

Preferably, $R_6$ is a $C_3$ or $C_4$ alkylene group. Most preferably, $R_6$ is a $C_3$ alkylene group.

Preferably, the polyether has a molecular weight of from about 750 to about 3,000; and more preferably from about 900 to about 1,500.

The Carboxylic Acid

The method of the present invention further involves a carboxylic acid compound. The carboxylic acid to be employed in the invention preferably may be represented by the formula:

$R_4(COOH)_y$ wherein $R_4$ represents a hydrocarbyl group having about 2 to about 50 carbon atoms, and y represents an integer of 1 to about 4.

The preferred hydrocarbyl groups are aliphatic groups, such as an alkyl group or an alkenyl group, which may have a straight chain or a branched chain. Examples of preferred carboxylic acids are aliphatic acids having about 8 to about 30 carbon atoms and include caprylic acid, pelargonic acid, capric acid, lauric acid, myristic acid, palmitic acid, margaric acid, stearic acid, isostearic acid, arachidic acid, behenic acid, lignoceric acid, cerotic acid, montanic acid, melissic acid, caproleic acid, palmitoleic acid, oleic acid, eraidic acid, linolic acid, linoleic acid, fatty acid or coconut oil, fatty acid of hardened fish oil, fatty acid of hardened rapeseed oil, fatty acid of hardened tallow oil, and fatty acid of hardened palm oil. Preferably, the carboxylic acid is oleic acid.

The Anhydride

The method of the present invention also involves an anhydride. The anhydride employed in the present invention is preferably an anhydride selected from the group consisting of succinic, glutaric, phthalic, and alkyl an hydrides. Examples of such anhydrides are illustrated by the following structures:

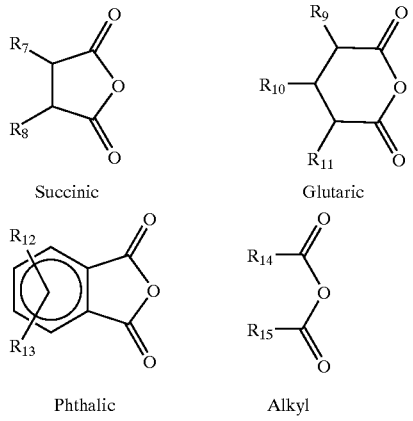

wherein $R_7$–$R_{15}$ are independently hydrogen or hydrocarbyl having about 2 to about 50 carbon atoms, provided that $R_{14}$ and $R_{15}$ are both alkyl. The preferred hydrocarbyl groups are aliphatic groups, such as an alkyl group or an alkenyl group, which may have a straight chain or a branched chain. Examples of preferred anhydrides are substituted succinic, glutaric, phthalic, and simple alkyl anhydrides having about 8 to about 30 carbon atoms in the substituent groups and include tetrapropenylsuccinic anhydride, polyisobutenylsuccinic anhydride, polyisopropenylsuccinic anhydride, dodecenylglutaric anhydride, tetrapropenylglutaric anhydride dodecenylphthalic anhydride, tetrapropenylphthalic anhydride, octanoic anydride, nonanoic anhydride, and decanoic anhydride. Preferably, the anhydride is tetrapropenylsuccinic anhydride.

Improved Compatibility

The method of the present invention provides improved compatibility of a fuel additive composition which comprises blending together the following components:

a) a Mannich condensation product of (1) a high molecular weight alkyl-substituted hydroxyaromatic compound wherein the alkyl group has a number average molecular weight of from about 300 to about 5,000 (2) an amine having the formula:

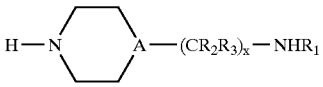

wherein A, $R_1$, $R_2$, $R_3$ and x are as defined herein; and (3) an aldehyde, wherein the respective molar ratio of reactants (1), (2), and (3) is 1:0.1–2.0:0.1–2.0;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a C, to $C_{30}$ hydrocarbyl group;

c) a carboxylic acid as represented by the formula:

$R_4(COOH)_y$ wherein $R_4$ represents a hydrocarbyl group having about 2 to about 50 carbon atoms, and y represents an integer of 1 to about 4; and d) an anhydride selected from the group consisting of succinic, glutaric, phthalic, and alkyl anhydrides.

Preferably, the Mannich condensation product, hydrocarbyl-terminated poly(oxyalkylene) monool, carboxylic acid, and anhydride are blended together at a temperature in the range of about room temperature (about 20° C.) to about 100° C.

In general, the total amount of carboxylic acid is 1 to about 15%, more preferably about 2 to about 10%, most preferably about 3 to about 8% of the weight of the Mannich condensation product, or there is typically about 0.2 to about 2.5, more preferably, about 0.3 to about 1.6, most preferably, about 0.5 to about 1.3, equivalents of carboxylic acid per equivalent of water-soluble amine in the Mannich condensation product.

In general, the total amount of an hydride is about 0.6 to about 6.0%, more preferably about 0.9 to about 4.5%, most preferably about 1.8 to about 3.0% of the weight of the Mannich condensation product, or there is typically about 0.2 to about 2.0, more preferably, about 0.3 to about 1.5, most preferably, about 0.6 to about 1.0, equivalent of an hydride per equivalent of water-soluble amine in the Mannich condensation product.

The carboxylic acid and anhydride treatment of the Mannich condensation product of the present invention provides improved compatibility with other additives in the desired finished fuel additive composition. Compatibility in this instance generally means that the components in the present invention as well as being fuel soluble in the applicable treat rate also do not cause other additives to precipitate under normal conditions. The improved compatibility manifests itself in less insoluble material such as haze and sediment.

EXAMPLES

The invention will be further illustrated by the following examples, which set forth particularly advantageous specific embodiments of the present invention. While the examples are provided to illustrate the present invention, it is not intended to limit it.

In the following examples and tables, the components of the fuel additive composition are defined as follows:

A. The term "Mannich" refers to a Mannich condensation product made from the reaction of polyisobutylphenol, formaldehyde, and 1-(2-aminomethyl)piperazine in a ratio of 1:1:1.05, prepared in the manner as described in Example 1. The polyisobutylphenol was produced from polyisobutylene containing at least 70% methylvinylidene isomer as described in U.S. Pat. No. 5,300,701.

B. The term "POPA" refers to a dodecylphenyl-terminated poly(oxypropylene) monool having an average molecular weight of about 1,000.

C. The Oleic Acid was available as Edenor Ti 05 or Emersol 221 from Cognis Corporation as well as from J. T. Baker Company and other suppliers.

D. The Tetrapropenylsuccinic Anhydride was available as DDSA from Milliken Chemical Company.

Example 1

Mannich Condensation Product 2738 g of a solution of polyisobutylphenol in C9 aromatic solvent (Solvarex 9 manufactured by TotalFinaElf was charged to a 5-L cylindrical glass reactor equipped with baffles, agitator, heating mantle, condenser, Dean-Stark trap, temperature and pressure control system. The polyisobutylphenol was produced from polyisobutylene containing at least 70% methylvinylidene isomer as described in U.S. Pat. No. 5,300,701. The polyisobutylphenol solution had a non-volatile residue content of 73.9% and a hydroxyl number of 41.4 mg KOH/g. The diluted polyisobutylphenol was warmed to 60–65° C. and then 263.9 g of 1-(2-aminoethyl) piperazine (AEP) was pumped from a 500-mL burette into the reactor over 10 minutes. 160 g of Exxon Aromatic 100 solvent was added to the burette to flush any remaining amine into the reactor. The AEP had an assay of 99.0% was charged to the reactor in the ratio 1.0 mole of AEP per mole of polyisobutylphenol. The AEP was thoroughly mixed with the polyisobutylphenol for 15 minutes, and then 68.9 g of paraformaldehyde (prill form, 92.5% purity, from Hoechst-Celanese) was quickly charged to the reactor. This amount of paraformaldehyde corresponded to 1.05 moles of formaldehyde per mole of polyisobutylphenol. The reactor headspace was purged continuously with nitrogen at about 100 $cm^3$/min while holding the reactor at atmospheric pressure. After agitating the reaction mixture for 15 minutes, the temperature was increased to 175° C. over 1.6 hours. As byproduct water formed, water and solvent vapor distilled from the reactor and passed up through the condenser to the Dean-Stark receiver. The byproduct water and solvent were separated in the receiver and the solvent returned to the reactor once the receiver was filled. The reaction mixture was held at 175° C. for 5 hours and the pressure controlled at atmospheric pressure with nitrogen purge. Most of the byproduct water was removed within the first two hours of the hold period and the reflux eventually stopped. At the end of the hold period, the nitrogen was turned off, the pressure was lowered to 9–10 psia and the reactor heated to maintain temperature so as to cause refluxing for approximately 30 minutes. This removed a small amount of additional byproduct water. The crude reaction product was cooled to ambient temperature and a 69.4-g sample of crude was found to contain 0.05 vol % sediment and 75.8% nonvolatile residue (about 24.2% solvent). The overhead receiver contained 44.8 g of aqueous phase and 90.3 g of solvent phase. 250 g of Exxon Aromatic 100 solvent and 10 g of Manville HyFlo Super Cel filter-aid were mixed into the crude product at about 60–65° C. The crude was filtered using a cylindrical pressure filter having an area of $1.113\times10^{-2}$ $m^2$ and precoated with 16 g of HyFlo Super Cel filter-aid. The crude was filtered at 65° C. and 90 psig and gave a filtrate rate of 857 kg/h/$m^2$. The high filtration rate suggested that the crude could have simply been "polish-filtered" through paper or a cartridge to remove the small amount of sediment.

The filtered Mannich condensation product was clear (0% haze using Nippon Denshoku Model 300A haze meter), light gold in color (2.0 by ASTM D1500), and contained 2.6% nitrogen and 70.1% nonvolatile residue. A 3-gram sample of the Mannich condensation product was diluted with 100 mL of hexane and 0.1 mL of demulsifier and then extracted twice with 40 mL of warm water. The water extract was titrated with 0.1 N hydrochloric acid. The water-soluble amine content was measured as 0.219 mEq/g.

Example 2

Comparative Compatibility and Air Sensitivity of Formulation With Mannich Condensation Product A typical formulation was blended at room temperature with treated Mannich condensation product and was used to test the effect of water-soluble amine concentration in the Mannich product on the compatibility and air sensitivity of the formulation with other components. The formulation is shown in Table 1. Light alkylate solvent is an aromatic solvent manufactured by Chevron Oronite S.A.

TABLE 1

Typical Compatibility and Air Sensitivity Test Formulation

| Component | Weight Percent |
|---|---|
| Mannich condensation product | 30 |
| Light alkylate solvent | 38.8 |
| Synthetic carrier fluid (POPA) | 30 |
| Demulsifier | 0.4 |
| Corrosion inhibitor | 0.8 |

Mannich condensation product formulation compatibility is measured at room temperature in a 100-mL cylindrical oil sample bottle made of clear glass and filled with the formulation. A cork is inserted into the mouth of the bottle to keep out air. The sample is stored in a rack open to the light in the room. Two qualitative visual rating scales are used; one for fluid appearance with ratings in the range of 0 to 6, and one for the amount of sedimentation with ratings in the range 0 to 4. A low rating number indicates good compatibility and a high rating number indicates poor compatibility. For example, an appearance rating of 6 means the formulation contained heavy cloud (close to opaque). A rating of 4 for sedimentation indicates the presence of a large amount of sediment in the bottom of the bottle. The typical requirement for a pass in this test is a fluid appearance rating in the range of 0 to 2 (absolutely bright to slight cloud) and a sedimentation rating 0 to 1 (no sediment to very slight sediment).

The air sensitivity of the test formulation containing treated Mannich condensation product is measured at room temperature using about 100 g of sample in a 250-mL beaker that is open to the air. A 500-mL beaker is inverted over the 250-mL beaker to keep out air drafts that would quickly cause solvent evaporation, while still allowing equilibration with the surrounding air. The beaker is weighed at the end to make sure the weight loss due to solvent evaporation is less than about 5%. If enough solvent is lost, component separation can occur. The air sensitivity test uses the same rating scales as the compatibility test. Both tests are supplemented when possible with haze measurements using a Nippon Denshoku Model 300A haze meter.

Diluted crude Mannich condensation product from Examples 1 and 2, each containing 0.219 mEq/g of water-soluble amine, was evaluated in the compatibility test for up to 30 days as shown in Table 2. Both diluted crude Mannich condensation product samples caused a failure in the formulation compatibility test. The formulation failed immediately due to heavy cloud formation. The initial haze was 61.5%. By 14 days a significant amount of sediment appeared due to settling of some of the insoluble material. This seemed to increase with time as evidenced by the increased sediment rating at 30 days and the decrease in haze to 48.9%.

A formulation air sensitivity test was also done with the diluted Mannich condensation product from Example 1. The results are shown in Table 3 and were very similar to the observations in the formulation compatibility test (Table 2).

Analysis of the sediment from a similar test using a diethylenetriamine-Mannich by infrared spectroscopy (IR) and nuclear magnetic spectroscopy (NMR) indicated the haze was caused by a reaction of the carboxylic acid corrosion inhibitor with the residual amine in the Mannich condensation product.

TABLE 2

Comparative Formulation Compatibility with Untreated Mannich Condensation Product from Example 1

| | Fluid/Sediment Rating in Compatibility Test | | | | | | |
|---|---|---|---|---|---|---|---|
| Blend Number | 1 Day | 3 Days | 7 Days | 14 Days | 21 Days | 30 Days | % Haze 30 Days |
| 151 | 6/0 | 6/0 | 6/0 | 6/2 | 6/3 | 6/3 | 48.9 |

TABLE 3

Comparative Formulation Air Sensitivity with Untreated Mannich Condensation Product from Example 1

| | Fluid/Sediment Rating in Compatibility Test | | | | | | |
|---|---|---|---|---|---|---|---|
| Blend Number | 1 Day | 3 Days | 7 Days | 14 Days | 21 Days | 30 Days | % Haze 30 Days |
| 151 | 6/0 | 6/0 | 6/0 | 6/2 | 6/3 | 3/3 | 21.7 |

Example 3

Comparative Formulation Compatibility and Air Sensitivity With Oleic Acid

The formulations were typically made in a 250–400-mL beaker with a stir plate and magnetic stirring bar to facilitate mixing. The components were blended at room temperature as follows. The diluted Mannich condensation product from Example 1 and the oleic acid were weighed into the beaker and then mixed for 30 minutes. Baker Chemical Company supplied the oleic acid having an acid number of 202 mg KOH/g. This acid number is very consistent with the assumed molecular weight of 282 used in our calculations.

Subsequent formulation components were weighed into the beaker and then mixed for one minute. After all components were added, the mixture was stirred for five more minutes. The order of addition of the other components was light alkylate solvent, synthetic carrier fluid, demulsifier, and corrosion inhibitor. Formulation compatibility and air sensitivity tests were performed on formulations containing varying amounts of oleic acid as shown in Tables 4–5. The percent oleic acid in Tables 4–5 is based on diluted Mannich condensation product of Example 1. For example 3% oleic acid means 3 grams of oleic acid for every 100 grams of diluted Mannich condensation product from Example 1. The amount of oleic acid is also shown on the basis of equivalents of oleic acid per equivalent of water-soluble amine (WSA) in Tables 4–5.

Table 4 shows that the addition of 3% oleic acid (0.48 equivalents/equivalent of WSA) to the diluted Mannich condensation product results in a dramatic improvement of formulation compatibility. The Mannich samples containing 3–10% oleic acid all resulted in formulations that passed the compatibility test.

TABLE 4

Improvement of Formulation Compatibility with Oleic Acid

| | % Oleic Acid | Fluid/Sediment Rating in Compatibility Test | | | | | | |
|---|---|---|---|---|---|---|---|---|
| Blend Number | (Eq./Eq. WSA) | 1 Day | 3 Days | 7 Days | 14 Days | 21 Days | 30 Days | % Haze 30 Days |
| 144 | 3 (0.48) | 0/0 | | 0/0 | 0/0 | | 1/0 | 3.6 |
| 176 | 8 (1.29) | 0/0 | 0/0 | 0/0 | 0/0 | 0/0 | 0/0 | 0.0 |
| 177 | 10 (1.62) | 0/0 | 0/0 | 0/0 | 0/0 | 0/0 | 0/0 | 0.0 |

Table 5 shows that the oleic acid greatly improved formulation air sensitivity. It took 8% oleic acid (1.29 equivalents/equivalent of WSA) to obtain a perfect result at 30 days. The initial haze measurements for blends 144, 176, and 177 were 0.0, 0.1, and 0.2%. Therefore, the fluid appearance of most of the formulations was very good even though a small amount of clear gelatinous sediment formed in some cases after a week (for example, blends 156 and 157). If the gelatinous sediment could be eliminated at lower oleic acid concentrations, the overall compatibility would be excellent.

These results are very surprising because the oleic acid seems to prefer to react with the unconverted amine rather than the amine that is part of the Mannich base structure. In addition, the offending corrosion inhibitor has carboxylic acid functionality like the oleic acid.

In general, this is quite a severe test because the formulations will be stored in tanks and vessels with very low air exposure, and nitrogen blanketing with captured vent systems in many cases. Therefore, the 8% of oleic acid required for a perfect pass of the air sensitivity test in practice may not be required. Lower amounts will likely suffice.

TABLE 5

Improvement of Formulation Air Sensitivity with Oleic Acid

| | % Oleic Acid | Fluid/Sediment Rating in Compatibility Test | | | | | | |
|---|---|---|---|---|---|---|---|---|
| Blend Number | (Eq./Eq. WSA) | 1 Day | 3 Days | 7 Days | 14 Days | 21 Days | 30 Days | % Haze 30 Days |
| 144 | 3 (0.48) | 0/0 | | 3/0 | 3/2 | | 2/3 | 7.1 |
| 156 | 4 (0.65) | 1/0 | 1/0 | 1/1 | 0/2 | 0/2 | 1/2 | 3.3 |

TABLE 5-continued

Improvement of Formulation Air Sensitivity with Oleic Acid

| Blend Number | % Oleic Acid (Eq./Eq. WSA) | Fluid/Sediment Rating in Compatibility Test 1 Day | 3 Days | 7 Days | 14 Days | 21 Days | 30 Days | % Haze 30 Days |
|---|---|---|---|---|---|---|---|---|
| 157 | 5 (0.81) | 0/0 | 1/0 | 1/1 | 0/2 | 0/2 | 1/2 | 3.1 |
| 158 | 6 (0.97) | 0/0 | 0/0 | 0/1 | 0/1 | 0/1 | 1/2 | 2.7 |
| 176 | 8 (1.29) | 0/0 | 0/0 | 0/0 | 0/0 | 0/0 | 0/0 | 0.1 |
| 177 | 10 (1.62) | 0/0 | 0/0 | 0/0 | 0/0 | 0/0 | 0/0 | 0.0 |

Example 4

Comparative Formulation Compatibility and Air Sensitivity With Tetrapropenylsuccinic Anhydride The experiments in Example 3 were repeated with tetrapropenylsuccininc anhydride (DDSA) instead of oleic acid. DDSA was supplied by Milliken Chemicals and had a neutralization number of 406 mg KOH/g. Milliken uses $C_{12}$ branched-chain olefin derived from propylene tetramer to make DDSA.

Tables 6–7 summarize the formulation compatibility and air sensitivity results. Tables 6 and 7 show that there were no problems with sediment in the formulation compatibility and air sensitivity tests when the diluted Mannich condensation product is treated with tetrapropenylsuccininc anhydride. The sediment rating in all cases was zero or perfect. The three formulations in Table 6 all had a hazy appearance to some degree due to some small clouds of material that did not appear to be soluble. However, the cloud did not seem to settle from the samples during the 30-day duration of the test.

TABLE 6

Comparative Formulation Compatibility with Tetrapropenylsuccininc Anhydride (DDSA)

| Blend Number | % DDSA (Eq./Eq. WSA) | Fluid/Sediment Rating in Compatibility Test 1 Day | 3 Days | 7 Days | 14 Days | 21 Days | 30 Days | % Haze 30 Days |
|---|---|---|---|---|---|---|---|---|
| 152 (Comp.) | 3 (0.99) | 2/0 | 4/0 | 4/0 | 4/0 | 4/0 | 4/0 | 1.7 |
| 174 (Comp.) | 5.5 (1.82) | 2/0 | 2/0 | 2/0 | 2/0 | 2/0 | 3/0 | 13.3 |
| 175 (Comp.) | 6 (1.98) | 2/0 | 2/0 | 2/0 | 2/0 | 2/0 | 3/0 | 15.2 |

Table 7 shows a similar phenomenon in the air sensitivity test. The sediment rating is always very good, but there is an area of cloud in the sample. The percent haze measurements are not always in good agreement with the fluid appearance rating given because the cloud was not dispersed evenly throughout the entire sample. This is quite different from the comparative observations in Tables 2–3.

TABLE 7

Comparative Formulation Air Sensitivity with Tetrapropenylsuccininc Anhydride

| Blend Number | % Oleic Acid (Eq./Eq. WSA) | Fluid/Sediment Rating in Compatibility Test 1 Day | 3 Days | 7 Days | 14 Days | 21 Days | 30 Days | % Haze 30 Days |
|---|---|---|---|---|---|---|---|---|
| 152 | 3 (0.99) | 2/0 | 4/0 | 4/0 | 4/0 | 4/0 | 4/0 | 1.7 |
| 159 | 4 (1.32) | 0/0 | 0/0 | 4/0 | 4/0 | 4/0 | 4/0 | 0.7 |
| 160 | 5 (1.65) | 0/0 | 0/0 | 0/0 | 0/0 | 4/0 | 4/0 | 0.2 |
| 174 | 5.5 (1.82) | 2/0 | 2/0 | 2/0 | 3/0 | 3/0 | 6/0 | 11.1 |
| 175 | 6 (1.98) | 2/0 | 2/0 | 2/0 | 3/0 | 3/0 | 6/0 | 0.1 |

Example 5

Improvement of Formulation Compatibility and Air Sensitivity With a Combination of Tetrapropenylsuccinic Anhydride and Oleic Acid Example 3 showed that diluted Mannich condensation product treated with oleic acid gave very good improvement in fluid appearance rating in the formulation air sensitivity test compared to Example 2. However, the fluid sediment rating did not improve as well without using increased amounts of oleic acid over that needed for excellent results in the formulation compatibility test of Example 3. Example 4 showed that diluted Mannich condensation product treated with tetrapropenylsuccininc anhydride gave very good improvement in fluid sediment rating in the formulation air sensitivity test compared to Example 2. However, the fluid appearance rating did improve much relative to Example 3 even with the addition of increasing amounts of tetrapropenylsuccininc anhydride.

We have made the surprising discovery that the combination of both oleic acid and tetrapropenylsuccininc anhydride improves the formulation compatibility and air sensitivity compared to Examples 2–4. Tables 8–9 show the results of these experiments. Table 8 shows that diluted Mannich condensation product that was treated with combinations of 2–6% oleic acid and 1–3% tetrapropenylsuccininc anhydride all resulted in excellent formulation compatibility. The same was true for formulation air sensitivity as shown in Table 9. These experiments show that treating the diluted Mannich condensation product with a combination of 3% oleic acid and 2% tetrapropenylsuccinic anhydride (Blend #169) instead of 8% oleic acid gives the same excellent results in formulation compatibility and air sensitivity tests. Thus, this combination of Mannich treating agents allows for reduction in the total mass of treatment material added and the ability to optimize the treatment cost.

TABLE 8

Improvement of Formulation Compatibility with Combinations of Oleic Acid and Tetrapropenylsuccininc Anhydride (DDSA)

| Blend Number | % Oleic Acid (Eq./Eq. WSA) | % DDSA (Eq./Eq. WSA) | Fluid/Sediment Rating in Compatibility Test 1 Day | 3 Days | 7 Days | 14 Days | 21 Days | 30 Days | % Haze 30 Days |
|---|---|---|---|---|---|---|---|---|---|
| 171 | 2 (0.32) | 3 (0.99) | 0/0 | 0/0 | 0/0 | 0/0 | 0/0 | 0/0 | 0.1 |
| 169 | 3 (0.48) | 2 | 0/0 | 0/0 | 0/0 | 0/0 | 0/0 | 0/0 | 0.0 |
| 170 | 3 (0.48) | 3 (0.99) | 0/0 | 0/0 | 0/0 | 0/0 | 0/0 | 0/0 | 0.1 |
| 172 | 6 (0.97) | 1 (0.33) | 0/0 | 0/0 | 0/0 | 0/0 | 0/0 | 0/0 | 0.0 |
| 173 | 6 (0.97) | 2 | 0/0 | 0/0 | 0/0 | 0/0 | 0/0 | 0/0 | 0.0 |

TABLE 9

Improvement of Formulation Air Sensitivity with Combinations of Oleic Acid and Tetrapropenylsuccininc Anhydride (DDSA)

| Blend Number | % Oleic Acid (Eq./Eq. WSA) | % DDSA (Eq./Eq. WSA) | Fluid/Sediment Rating in Compatibility Test 1 Day | 3 Days | 7 Days | 14 Days | 21 Days | 30 Days | % Haze 30 Days |
|---|---|---|---|---|---|---|---|---|---|
| 171 | 2 (0.32) | 3 (0.99) | 0/0 | 0/0 | 0/0 | 0/0 | 0/0 | 0/0 | 0.1 |
| 161 | 3 (0.48) | 1 (0.33) | 0/0 | 0/0 | 0/1 | 0/1 | 0/1 | 1/2 | 2.9 |
| 162 | 3 (0.48) | 2 (0.66) | 0/0 | 0/0 | 0/0 | 0/0 | 0/0 | 1/1 | 1.1 |
| 169 | 3 (0.48) | 2 (0.66) | 0/0 | 0/0 | 0/0 | 0/0 | 0/0 | 0/0 | 0.0 |
| 170 | 3 (0.48) | 3 (0.99) | 0/0 | 0/0 | 0/0 | 0/0 | 0/0 | 0/0 | 0.1 |
| 172 | 6 (0.97) | 1 (0.33) | 0/0 | 0/0 | 0/0 | 0/0 | 0/0 | 0/0 | 0.2 |
| 173 | 6 (0.97) | 2 (0.66) | 0/0 | 0/0 | 0/0 | 0/0 | 0/0 | 0/0 | 0.1 |

While the present invention has been described with reference to specific embodiments, this application is intended to cover those various changes and substitutions that may be made by those skilled in the art without departing from the spirit and scope of the appended claims.

What is claimed is:

1. A method of improving the compatibility of a fuel additive composition, said method comprising blending together the following components:

a) a Mannich condensation product of (1) a high molecular weight alkyl-substituted hydroxyaromatic compound wherein the alkyl group has a number average molecular weight of from about 300 to about 5,000 (2) an amine having the formula:

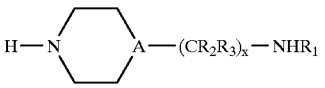

wherein A is CH or nitrogen, $R_1$, $R_2$, $R_3$ are independently hydrogen or lower alkyl of 1 to about 6 carbon atoms and each $R_2$ and $R_3$ is independently selected in each —$CR_2R_3$— unit, and x is an integer from 1 to about 6;

and (3) an aldehyde, wherein the respective molar ratio of reactants (1), (2), and (3) is 1:0.1–2:0.1–2;

b) a hydrocarbyl-terminated poly(oxyalkylene) monool having an average molecular weight of about 500 to about 5,000, wherein the oxyalkylene group is a $C_2$ to $C_5$ oxyalkylene group and the hydrocarbyl group is a $C_1$ to $C_{30}$ hydrocarbyl group;

c) a carboxylic acid as represented by the formula:

$$R_4(COOH)_y$$

wherein $R_4$ represents a hydrocarbyl group having about 2 to about 50 carbon atoms, and y represents an integer of 1 to about 4; and d) an anhydride selected from the group consisting of succinic, glutaric, phthalic, and alkyl anhydrides.

2. The method according to claim 1, wherein the alkyl group on said alkyl-substituted hydroxyaromatic compound has a number average molecular weight of about 400 to about 3,000.

3. The method according to claim 2, wherein the alkyl group on said alkyl-substituted hydroxyaromatic compound has a number average molecular weight of about 500 to about 2,000.

4. The method according to claim 3, wherein the alkyl group on said alkyl-substituted hydroxyaromatic compound has a number average molecular weight of about 700 to about 1,500.

5. The method according to claim 1, wherein said alkyl-substituted hydroxyaromatic compound is a polyalkylphenol.

6. The method according to claim 5, wherein the polyalkylphenol is polypropylphenol or polyisobutylphenol.

7. The method composition according to claim 6, wherein the polyalkylphenol is polyisobutylphenol.

8. The method according to claim 7, wherein the polyisobutylphenol is derived from polyisobutene containing at least about 70% methylvinylidene isomer.

9. The method according to claim 1, wherein A is CH or nitrogen, $R_1$ is hydrogen, $R_2$ and $R_3$ are independently hydrogen or lower alkyl having from 1 to about 4 carbon atoms, and x is an integer 1 to about 4.

10. The method according to claim 9, wherein A is CH or nitrogen, $R_1$ is hydrogen, $R_2$ and $R_3$ are independently hydrogen or lower alkyl having from 1 to about 2 carbon atoms, and x is an integer of about 2.

11. The method according to claim 10, wherein A is nitrogen, $R_1$, $R_2$, and $R_3$ are hydrogen, and x is an integer of about 2.

12. The method according to claim 1, wherein the aldehyde component of said Mannich condensation product is formaldehyde, paraformaldehyde, or formalin.

13. The method according to claim 1, wherein the respective molar ratio of reactants (1), (2), and (3) is 1:0.5–1.5:0.5–1.

14. The method according to claim 1, wherein the respective molar ratio of reactants (1), (2), and (3) is 1:0.8–1.3:0.8–1.3.

15. The method according to claim 1, wherein the respective molar ratio of reactants (1), (2), and (3) is 1:1:1.05.

16. The method according to claim 1, wherein said hydrocarbyl-terminated poly(oxyalkylene) monool has an average molecular weight of about 900 to about 1,500.

17. The method according to claim 1, wherein the oxyalkylene group of the hydrocarbyl-terminated polyoxyalkylene group of said hydrocarbyl-terminated poly (oxyalkylene) monool is a $C_3$ to $C_4$ oxyalkylene group.

18. The method composition according to claim 17, wherein the oxyalkylene group of said hydrocarbyl-terminated poly(oxyalkylene) monool is a $C_3$ oxypropylene group.

19. The method according to claim 17, wherein the oxyalkylene group of said hydrocarbyl-terminated poly (oxyalkylene) monool is a $C_4$ oxybutylene group.

20. The method according to claim 1, wherein the hydrocarbyl group of said hydrocarbyl-terminated poly (oxyalkylene) monool is a $C_7$ to $C_{30}$ alkylphenyl group.

21. The method according to claim 1, wherein said carboxylic acid is about 0.2 to about 2.5 equivalent of carboxylic acid per equivalent of water-soluble amine in the Mannich condensation product.

22. The method according to claim 21, wherein said carboxylic acid is about 0.3 to about 1.6 equivalent of carboxylic acid per equivalent of water-soluble amine in the Mannich condensation product.

23. The method according to claim 22, wherein said carboxylic acid is about 0.5 to about 1.3 equivalent of carboxylic acid per equivalent of water-soluble amine in the Mannich condensation product.

24. The method according to claim 23, wherein said carboxylic acid has about 8 to about 30 carbon atoms.

25. The method according to claim 24, wherein said carboxylic acid is oleic acid.

26. The method according to claim 1, wherein said anhydride is about 0.2 to about 2.0 equivalent of anhydride per equivalent of water-soluble amine in the Mannich condensation product.

27. The method according to claim 26, wherein said anhydride is about 0.0.3 to about 1.5 equivalent of anhydride per equivalent of water-soluble amine in the Mannich condensation product.

28. The method according to claim 27, wherein said anhydride is about 0.6 to about 1.0 equivalent of anhydride per equivalent of water-soluble amine in the Mannich condensation product.

29. The method according to claim 28, wherein said anhydride is a succinic anhydride.

30. The method according to claim 29, wherein said succinic anhydride is tetrapropenyl succinic anhydride.

31. The method according to claim 1, wherein the Mannich condensation product, hydrocarbyl-terminated poly (oxyalkylene) monool, carboxylic acid, and anhydride are blended together at a temperature in the range of about room temperature to about 100° C.

* * * * *